US006328488B1

(12) United States Patent
Kobayashi

(10) Patent No.: US 6,328,488 B1
(45) Date of Patent: Dec. 11, 2001

(54) AUTOMATIC PROCESSOR FOR SILVER HALIDE PHOTOGRAPHIC LIGHT-SENSITIVE MATERIAL

(75) Inventor: Hiroaki Kobayashi, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/556,479

(22) Filed: Apr. 21, 2000

(30) Foreign Application Priority Data

Apr. 23, 1999 (JP) ..... 11-115669

(51) Int. Cl.[7] ..... G03D 5/00; G03D 3/02
(52) U.S. Cl. ..... 396/604; 396/627
(58) Field of Search ..... 396/626, 627, 396/570, 571, 604, 631

(56) References Cited

U.S. PATENT DOCUMENTS

| | | | | |
|---|---|---|---|---|
| 4,121,236 | | 10/1978 | Welp et al. | 396/627 |
| 4,421,399 | | 12/1983 | Steube | 396/626 |
| 5,832,328 | * | 11/1998 | Ueda | 396/572 |
| 6,126,339 | * | 10/2000 | Kobayashi | 396/626 |

FOREIGN PATENT DOCUMENTS

| | | |
|---|---|---|
| 0 620 495 A1 | 10/1994 | (EP) . |
| 2 102 700 A | 2/1983 | (GB) . |
| 6-324455 | 11/1994 | (JP) . |
| 8-206569 | 8/1996 | (JP) . |
| 9-211832 | 8/1997 | (JP) . |

* cited by examiner

*Primary Examiner*—David M. Gray
(74) *Attorney, Agent, or Firm*—Finnegan, Henderson, Farabow, Garrett and Dunner, L.L.P.

(57) ABSTRACT

An apparatus for processing a photographic light sensitive material with a processing solution, comprises a jetting head provided so as to face the photographic light sensitive material with air space and having a plurality of orifices through which the processing solution is jetted toward the photographic light sensitive material; a supplying device to apply a pressure to the processing solution and to supply the pressed processing solution to the jetting head; a conduit provided between the supplying device and the jetting head so as to transmit the pressed processing solution from the supplying device to the jetting head; a valve provided on the conduit so as to open or close the conduit; and a controller to control a supplying amount of the processing solution by controlling a duty ratio of an opening time period to a closing time period of the valve per a unit time.

14 Claims, 6 Drawing Sheets

AUTOMATIC PROCESSOR FOR SILVER HALIDE PHOTOGRAPHIC LIGHT-SENSITIVE MATERIAL

BACKGROUND OF THE INVENTION

The present invention relates to an automatic processor for a silver halide photographic light-sensitive material (hereinafter referred to simply as a light-sensitive material), and in particular, to an automatic processor for a silver halide photographic light-sensitive material wherein processing capacity at high speed is excellent, stability in continuous jetting is excellent, and neither mist nor jet failure caused by contamination of a nozzle plate is caused.

Due to a recent rapid increase of mini-lab photofinishing labs, the number of light-sensitive materials to be processed in one lab has been reduced, and a rate of replacement of processing solution in a processing tank is lowered accordingly. Therefore, a processing solution tends to be deteriorated and tends not to maintain stable processing capacity. Further, there have recently been increased demands for a mini-lab wherein maintenance such as cleaning of an equipment and daily control are not required.

Therefore, TOKKAIHEI No. 6-324455 discloses a technology wherein a processing solution for processing a silver halide photographic light-sensitive material is contained in a container (for example, an ink jet head) which is highly airtight, and the processing solution is supplied to an emulsion side through a gaseous phase.

However, the ink jet head stated above is structured to jet an extremely small droplet because it is generally required to form fine images, and an amount of solution to be supplied is established to be considerably small. Therefore, when a conventional ink jet head is used as it is, an amount of processing solution to be supplied to an emulsion side of a light-sensitive material is insufficient, and absolute insufficiency of components (for example, color developing agents) necessary to conduct processing is caused. It is therefore difficult to finish reaction in processing steps completely.

For example, even in the case of increasing the number of jet nozzles (orifices) in the ink jet described in U.S. Pat. No. 4,901,093 to realize high speed processing capacity, an amount of solution to be supplied is still insufficient, in the case of a processing solution which processes a silver halide photographic light-sensitive material, It has been found that maintenance such as cleaning of a head section is needed to maintain more stable jet, and clogging of a nozzle tends to be caused.

The technology disclosed in TOKKAIHEI 6-324455 is one to process a light-sensitive material mainly for redox amplification processing. Since an amount of coated silver of a light-sensitive material for redox amplification processing is much less than that for an ordinary light-sensitive material, even when this technology is applied to processing of an ordinary light-sensitive material which is an object of the present invention, an effect which can be obtained is no more than an insufficient effect, and this technology can not be put to practical use.

In the control valve and its control method both disclosed in the technology stated above, stable jet is difficult. Namely, there is no description of timing for opening and closing of the valve, and it can not be put to practical use for the reason of occurrence of mist.

The technology described in TOKKAIHEI 9-211832 is a technology diverted from an ink jet method of a thermal development system, and it is far from the solution of the problem of stability of continuous jet which is specific to silver halide photographic processing of the present invention.

In recent years, there has been a rapid increase in the number of mini-lab photofinishing labs, especially because of the strong demand for rapid processing. Under this situation, simple control, high speed processing and rapid processing are demanded. The ink jet head stated above, however, is structured originally to jet an extremely small droplet, and a solution necessary for reaction can not be supplied sufficiently. On the other hand, when an ink jet having plural nozzles is used for a long time under a great load (such as simultaneous jet from all nozzles), it is difficult to supply the necessary amount stably. An indispensable technology, therefore, is to increase an amount of jet for a processing solution sharply and to conduct stable jet.

It has been found newly that air bubbles tend to be mixed in a solution because processing speed for continuous processing is higher compared with an occasion of an ink jet. Namely, due to this, pressure loss in a chamber is caused and a jet failure is caused. It was also found that an air bubble generated does not get out of a chamber easily in the case of a processing solution. Compared with ordinary ink, a processing solution for photographic use has an extremely high salt concentration of inorganic salt, and thereby, air bubbles tend to be generated, which makes it difficult to solve the problem.

TOKKAIHEI No. 8-206569 discloses a method to supply a processing solution to a photographic material by the use of a spray bar. Due to this, an amount of a processing solution can be increased sharply, but it was found that generation of mist caused by mixture of air bubbles and by mixture of minute insoluble matters is a problem.

SUMMARY OF THE INVENTION

Accordingly, the first object of the invention is to provide an automatic processor for a silver halide photographic light-sensitive material wherein a large amount of jet can be obtained stably when jetting a processing solution for a silver halide photographic light-sensitive material, and aptitude for rapid operations is assured. The second object is to provide an automatic processor for a silver halide photographic light-sensitive material wherein spot problems of color development are not caused. Further, the third object is to provide an automatic processor for a silver halide photographic light-sensitive material wherein neither deflection of jetting direction nor occurrence of mist is caused. Furthermore, the fourth object is to provide an automatic processor for a silver halide photographic light-sensitive material wherein no clogging of an orifice is caused even when the processor is used for a long time. The fifth object is to provide an automatic processor for a silver halide photographic light-sensitive material wherein an amount of waste solution is small to give less load to environment.

Under the background stated above, the inventors of the present invention studied in many ways to solve the aforesaid problems, and found out that the following structures can attain the objects mentioned above. (Structure 1) An automatic processor for a silver halide photographic light-sensitive material having a processing solution supply means which supplies a processing solution directly to a silver halide photographic light-sensitive material by jetting the pressurized processing solution for a silver halide photographic light-sensitive material through repetition of opening and shutting of a control valve.

In the structure described in Structure 1 wherein the processing solution is supplied directly to a silver halide photographic light-sensitive material by jetting the pressurized processing solution for a silver halide photographic light-sensitive material through repetition of opening and shutting of a control valve, it is possible to obtain a large amount of jetting stably, aptitude for rapid operations is assured, spot problems of color development are not caused, neither deflection of jetting direction nor occurrence of mist is caused, maintenance is easy, no clogging of orifice is caused for the use for a long time, and an amount of waste solution is small to give less load to environment.

(Structure 2) The automatic processor for a silver halide photographic light-sensitive material in accordance with Structure 1, wherein the processing solution supply means adjusts a duty ratio of the control valve according to an amount of a processing solution to be supplied.

In the structure described in Structure 2, it is possible to obtain a large amount of jet stably by adjusting a duty ratio of the control valve according to an amount of a processing solution to be supplied, and aptitude for rapid operations is assured.

(Structure 3) The automatic processor for a silver halide photographic light-sensitive material in accordance with Structure 1 or Structure 2, wherein one control valve is communicated with plural orifices for jetting processing solution in the processing solution supply means.

In the structure described in Structure 3, it is possible to jet uniformly in a wide range and to obtain a large amount of jet stably, and aptitude for rapid operations is assured, because one control valve is communicated with plural orifices for jetting processing solution.

(Structure 4) The automatic processor for a silver halide photographic light-sensitive material in accordance with either one of Structure 1–Structure 3, wherein the number of times for opening and shutting of the control valve per second is in a range from 10 to 1000 in the processing solution supply means.

In the structure described in Structure 4, the number of times for opening and shutting of the control valve per second is in a range from 10 to 1000, mist is not caused, a large amount of jet can be obtained stably, and aptitude for rapid operations is assured.

(Structure 5) The automatic processor for a silver halide photographic light-sensitive material in accordance with either one of Structure 1–Structure 4, wherein a ratio (output cross section)/(total cross section) representing a ratio of an output cross section of a control valve to the total cross section of orifices is in a range from 0.3 to 20, in the processing solution supply means.

In the structure described in Structure 5, a ratio (output cross section)/(total cross section) representing a ratio of an output cross section of a control valve to the total cross section of orifices is in a range from 0.3 to 20, and a large amount of jet can be obtained stably, and aptitude for rapid operations is assured.

(Structure 6) The automatic processor for a silver halide photographic light-sensitive material in accordance with either one of Structure 1–Structure 4, wherein a distance between the orifice and the silver halide photographic light-sensitive material is within a range from 0.5 mm to 10 mm.

In the structure described in Structure 6, a distance between the orifice and the silver halide photographic light-sensitive material is within a range from 0.5 mm to 10 mm, and neither deflection of jetting direction nor occurrence of mist is caused, and maintenance is easy.

(Structure 7) The automatic processor for a silver halide photographic light-sensitive material in accordance with either one of Structure 1–Structure 6, wherein a heating means which heats the silver halide photographic light-sensitive material up to 45 degrees or more is provided.

In the structure described in Structure 7, processing characteristics are excellent, aptitude for rapid operations is assured, and spot problems in color development are not caused, because a silver halide photographic light-sensitive material is heated up to 45 degrees or more.

(Structure 8) The automatic processor for a silver halide photographic light-sensitive material in accordance with either one of Structure 1–Structure 7, wherein there is provided a control means which controls an amount of supplied processing solution in the processing solution supply means to 5 ml–100 ml per 1 $m^2$ of the silver halide photographic light-sensitive material.

In the structure described in Structure 8, solution dripping on an emulsion surface of the silver halide photographic light-sensitive material after supply of the processing solution can be prevented, and it is possible to conduct processing which emits less amount of waste solution for less load to environment, because an amount of supplied processing solution is controlled to 5 ml–100 ml per 1 $m^2$ of the silver halide photographic light-sensitive material.

One of preferable embodiment of the invention is that surface tension of the processing solution is 25–50 dyne/cm. According to this embodiment, surface tension of the processing solution is 25–50 dyne/cm, and solution dripping on an emulsion surface of the silver halide photographic light-sensitive material after supply of the processing solution can be prevented.

Another preferable embodiment is that solute concentration of the processing solution is not less than 0.2% by weight. According to this embodiment, solute concentration of a processing solution is not less than 0.2% by weight, and rapid processing is possible.

DETAILED DESCRIPTION OF THE PREFERRED EMBODIMENT

Figure 1:
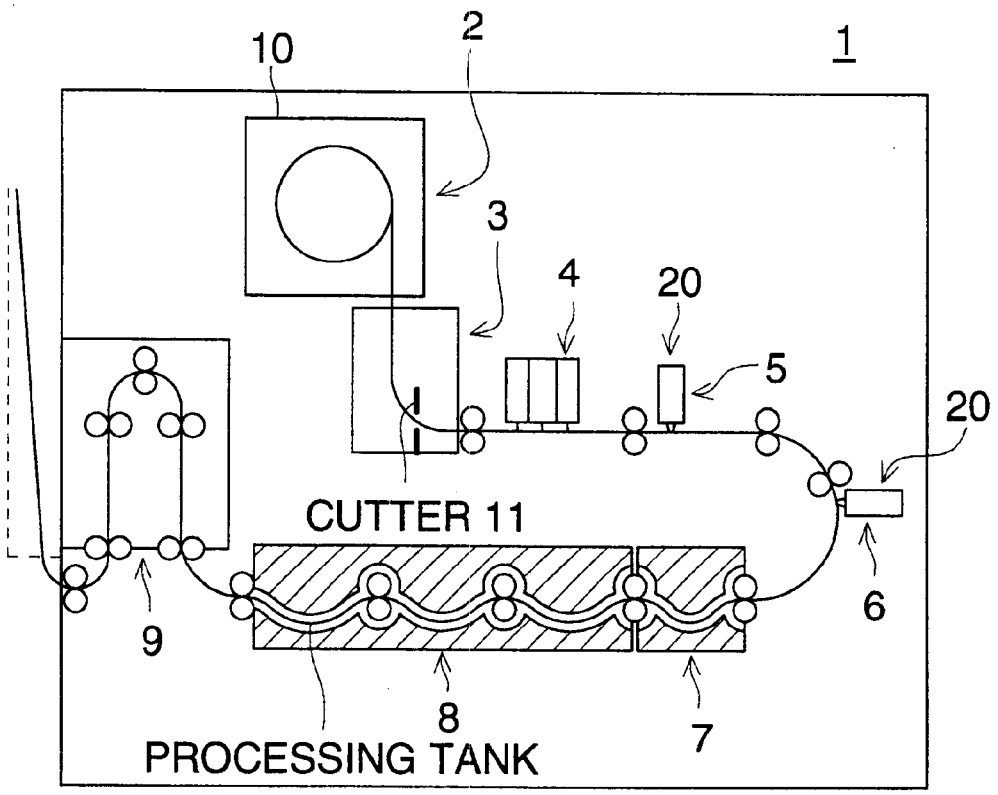
FIG. 1 is a diagram showing the schematic structure of an automatic processor for a silver halide photographic light-sensitive material.

The invention will be explained in detail as follows.

(Processing solution supply means)

A processing solution supply means supplies a pressurized processing solution for a silver halide photographic light-sensitive material directly to the silver halide photographic light-sensitive material through jetting by means of repetition of opening and shutting of a control valve. The control valve of the invention is a valve to control opening and shutting of a passage for the pressurized processing solution, and it repeats opening and shutting with electric signals to jet a processing solution through an orifice when it is opened. This control valve is composed, for example, of a solenoid, a valve body and a chamber, and a pressurized processing solution is supplied to the chamber through an inlet by opening and shutting actions of the valve body, and it is sent to an orifice at the nozzle section from an outlet.

The control valve has only to be one which can withstand a certain level of pressure. To be concrete, it is preferable that opening and shutting of the control valve is represented by opening and closing of a minute hole. The number of times for opening and shutting per second is preferably from 10 times to 1000 times. When the number of times is small, pressure to be applied on an orifice is lowered, and stable jetting is impossible. When the number of times is great, a solution more than necessary in terms of volume is jetted because of the response of the control valve, which makes the control of supplying to be difficult. More preferable is from 50 times to 500 times.

Two or more orifices are provided on the outlet of a control valve. From the viewpoint of increasing efficiency of supplying to a light-sensitive material, more orifices are better, but from the viewpoint of stability of jetting, the number of orifices from 2 to 250 is preferable, and the more preferable is from 3 to 128. Since one control valve is communicated with plural orifices for jetting processing solution, uniform jetting in a wide range is possible, a large amount of jet can be obtained uniformly and stably, and aptitude for rapid operations is assured.

Duty ratio of the control valve is adjusted in accordance with an amount of processing solution to be supplied. The duty ratio of the control valve is defined by a difference between opened time and closed time in a unit-hour, and when the duty ratio of the control valve is adjusted, a large amount of jet can be obtained stably and aptitude for rapid operations is assured.

It is preferable that a pressure applied to the control valve of the processing solution supply means is constant, and a higher pressure is preferable from the viewpoint of stable jetting. While, from the viewpoint of the response of operations of the control valve and occurrence of mist, the pressure applied on the control valve is preferably within a range from 0.05 $kgf/cm^2$ to 3.0 $gf/cm^2$, and it is more preferably within a range from 0.1 $gf/cm^2$ to 1.5 $gf/cm^2$.

For stable jetting of processing solutions for silver halide photographic light-sensitive material in the invention, a ratio of L representing an orifice length to R representing a diameter of an orifice on the jetting side is preferably within a range from 0.5 to 100, the more preferable range is from 2 to 40, and the range which is especially preferable is from 5 to 20.

The preferable length L of the orifice is in a range from 0.05 mm to 5 mm, and the more preferable range is from 0.1 mm to 1 mm. The preferable diameter of the orifice on the jetting surface side is within a range from 0.02 mm to 0.1 mm.

Further, a ratio of output cross section S1 at an outlet of the control valve to total cross section S2 of orifices representing a ratio (output cross section S1)/(total cross section S2) is in a range from 0.3 to 20, in the processing solution supply means, and a large amount of jet can be obtained stably; and aptitude for rapid operations is assured. The more preferable S1/S2 is in a range from 0.5 to 10, and what is especially preferable for S1/S2 is in a range from 1 to 7. Here, the output cross section S1 is a cross section of outlet 24*e* in FIG. 3(*b*).

Next, materials of a solution-contact section will be explained. The solution-contact section is a member constituting a path covering from a solution tank where a solution is stocked to a nozzle section for jetting, and it is a member which is directly in contact with a processing solution. To be concrete, the solution-contact section includes an inlet of a chamber of the processing solution supply means, the surface of a wall of the chamber and the surface of a wall forming the orifice, and a member which is in contact with pressurized solution is especially included in the solution-contact section. Preferable concrete materials of the members stated above include vinylidenechloride resin, vinyochboride resin, epoxy resin, liquid crystal polyester, polyimide resin, polystyrene, polyethylene terephthalate, polyphenylene sulfide, ceramic, FOTFORM Glass in glass ceramic, FOTOFORM OPAL GLASS-Ceramic, FOTOCREAM Glass-Ceramic (made by Hoya Glass Co.), SUS302, SUS303, SUS304, SUS316, SUS317, titanium alloy, nickel, Ta, chromium, silicon and silicon dioxide.

A processing solution supply speed in the invention is represented by a volume of a processing solution supplied to a light-sensitive material from a processing solution supply means in a second. From the viewpoint of rapid processing, the processing solution supply speed is preferably in a range from 0.01 ml/sec to 2.5 ml/sec, and the more preferable range is from 0.1 ml to 1.0 ml, in the invention.

A distance between an inlet of an orifice for a processing solution and an emulsion side of a light-sensitive material is preferably from 0.5 mm to 10 mm, and a range from 1.5 mm to 5 mm is more preferable.

(Heating means for a light-sensitive material)

It is preferable that a means to heat a light-sensitive material is provided on an automatic processor for a silver halide photographic light-sensitive material. As the heating means, there are given some methods employing a heat drum, a heat belt, a drier, infrared rays and high-frequency electromagnetic waves. A light-sensitive material may be heated at any time, including the times before and after a processing solution is supplied, but from the viewpoint of rapid processing, heating before supply of a processing solution is preferable. The temperature of the heated light-sensitive material is preferably not lower than 35° C., and it is more preferable to be 40° C. or more, from the viewpoint of rapid processing. It is further preferable to be 100° C. or less from heat-resisting property of a light-sensitive material, and 80° C. or less is more preferable. To prevent an adverse effect on an emulsion side of the light-sensitive material to be processed, it is preferable that a light-sensitive material is heated from the side which is opposite to an emulsion side.

(Processing steps)

Though an automatic processor for a silver halide photographic light-sensitive material in the invention may be used at any steps provided that the step is a processing step for processing a light-sensitive material with a processing solution, it is preferable that the automatic processor is used for a processing step where dyes are generated or an oxidation reaction is shown such as a developing step, a color developing step and a bleaching step, rather than used for a step to remove useless substances from a light-sensitive material such as a fixing step and a stabilizing step. Among these processing steps, the developing step and the color developing step are preferable, and the color developing step is especially preferable from the viewpoint of storage stability relating to generation of tar caused by oxidation of developing agents.

(Processing solution)

A processing solution used in the invention includes not only ordinary solutions but also solution which can not complete processing reaction by itself, and all of solutions containing components which can contribute to processing of light-sensitive materials and simple water are also included. The components contributing to processing of light-sensitive materials mentioned here include not only color developing agents and alkali agents but also components contributing less to processing reaction such as surface active agents.

In the automatic processor for a silver halide photographic light-sensitive material of the invention, it is possible to supply at a time a solution containing all components necessary for processing solutions for processing steps, or it is possible to make necessary components to be contained in plural solutions and to supply them separately to the light-sensitive material. When supplying plural solutions separately, it is preferable, from the viewpoint of rapid processing, that a period of time for completion of supplying of all solutions is as short as possible, and the period of 5 seconds or less or of 1 second or less is preferable.

Surface tension of a processing solution in the invention is preferably within a range from 25 dyne/cm to 50 dyne/cm. The more preferable is 30–45 dyne/cm. To adjust to this surface tension, it is preferable to add the following surface active agents to a processing solution.

In the invention, the processing solution preferably contains at least one of compounds represented by the following formulas [I], [SI], [S-II], and [S-III]:

$$\text{Rf-}(X)_m(Y)_n\text{—A} \qquad \text{formula [I]}$$

In formula [I], Rf represents a saturated or unsaturated alkyl group having at least one fluorine atom, the alkyl group having preferably 4–12 carbon atoms, and more preferably 6–9 carbon atoms, X includes a sulfonamido group,

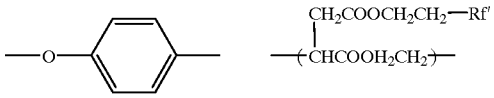

Y includes an alkylene oxide group and an alkylene group, Rf' represents a saturated or unsaturated hydrocarbon group having at least one fluorine atom, A represents a hydrophilic group such as —$SO_3M$, —$OSO_3M$, —COOM, —$OPO_3(M_1)(M_2)$, —$PO_3(M_1)(M_2)$, preferably —$SO_3M$, in which M, $M_1$, and $M_2$ independently represent H, Li, K, Na, or $NH_4$, preferably Li, K, Na, and most preferably Li, m represents an integer of 0 or 1, and preferably 0, and n represents an integer of 0 to 10, and preferably 0.

$$R^1X\,(E^1)_{l1}(E_2E)_{m1}(E^3)_{n1}\text{—}R^1 \qquad \text{formula [SI]}$$

In formula [SI], $R^1$ represents a hydrogen atom, an aliphatic group, or an acyl group, $R_2$ represents a hydrogen atom, or an aliphatic group, $E^1$ represents ethylene oxide, $E^2$ represents propylene oxide, $E^3$ represents ethylene oxide, X represents an oxygen atom or —$R^3$N— in which $R^3$ represents a hydrogen atom, an aliphatic group, or $$(E^1)_{l2}(E^2)_{m2}(E^3)_{n2}\text{—}R^4$$

$R^4$ represents a hydrogen atom or an aliphatic group, and $l_1$, $l_2$, $m_1$, $m_2$, $n_1$, and $n_2$ independently represent 0 to 300.

$$A_2\text{—O—}(B)_m(C)_n\text{—}X_1 \qquad \text{formula [SII]}$$

In formula [SII], $A_2$ represents a monovalent organic group such as an alkyl group having a carbon atom number of 6 to 50, preferably 6 to 35 (for example, a hexyl group, a heptyl group, an octyl group, a nonyl group, a decyl group, an undecyl group, or dodecyl group), or an aryl group having an alkyl group having a carbon atom number of 3 to 35, or an alkenyl group having a carbon atom number of 2 to 35.

The preferable substituent on the aryl group includes an alkyl group having a carbon atom number of 1 to 18 (for example, an unsubstituted alkyl group such as a methyl group, a propyl group, a butyl group, a pentyl group, a hexyl group, a heptyl group, an octyl group, a nonyl group, a decyl group, an undecyl group, or dodecyl group), a substituted alkyl group such as a benzyl group or a phenetyl group, or an alkenyl group having a carbon atom number of 2 to 20 (for example, an unsubstituted alkenyl group such as an oleyl group, a cetyl group or an allyl group, or a substituted alkenyl group such as a styryl group). The aryl group includes a phenyl group, a biphenyl group, or a naphthyl group, preferably a phenyl group. The position on the aryl group to be substituted may be an ortho, meta, or para position, and the plural substituents may be present on the aryl group.

B and C independently represent ethylene oxide, propylene oxide, or

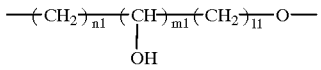

wherein $n_1$, $m_1$, and $I_1$ independently represent an integer of 0, 1, 2, or 3. m and n independently represent an integer of 0 to 100. $X_1$ represents a hydrogen atom, an alkyl group, an aralkyl group or an aryl group, for example, those as denoted in $A_2$ above. S-III

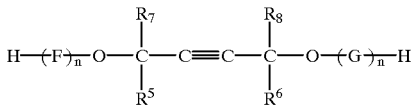

In formula S-III, $R^5$, $R^6$, $R_7$, and $R^8$ independently represent a hydrogen atom, or an aliphatic group, F and G independently represents ethylene oxide or propylene oxide, and m and n independently represent an integer of 0 to 100.

I-1

$C_8F_{17}SO_3K$

I-2

$C_8F_{17}SO_3Li$

I-3

$C_8F_{17}COONH_4$

I-4

$C_8F_{17}COOK$

I-5

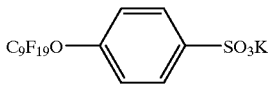

I-6

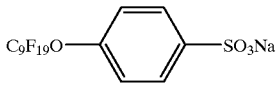

-continued

I-7

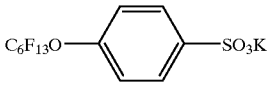

I-8

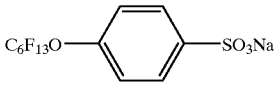

I-9

$C_7F_{15}CONHC_2H_4NC_5H_4Cl$

I-10

$C_7F_{15}CONH$

I-11

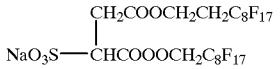

I-12

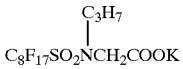

I-13

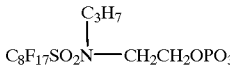

I-14

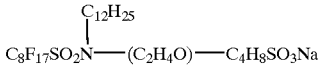

Among the compounds represented by formula [I], the preferable are compounds represented by (I-1), (I-2), (I-4) or (I-8)

The above compounds are synthesized by an ordinary synthetic method, and are also available on the market.

(Compounds represented by formula [SI])

SI-1

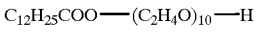

SI-2

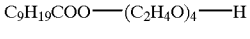

SI-3

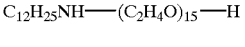

SI-4

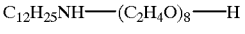

SI-5

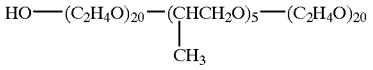

SI-6

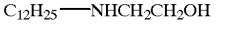

SI-7

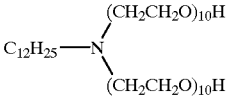

SI-8

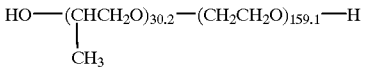

(Compounds represented by formula [SII])

SII-1

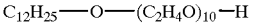

-continued

SII-2

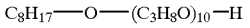

SII-3

SII-4

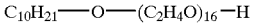

SII-5

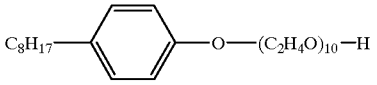

SII-6

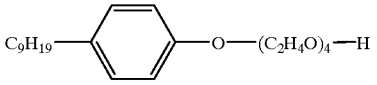

SII-7

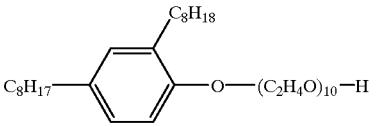

SII-8

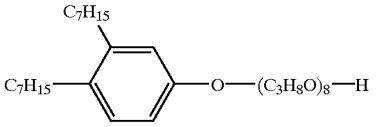

SII-9

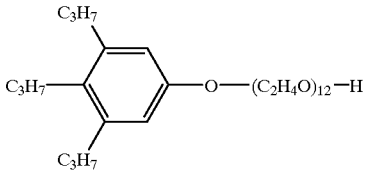

SII-10

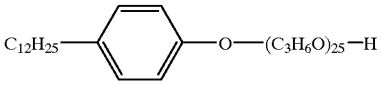

SII-11

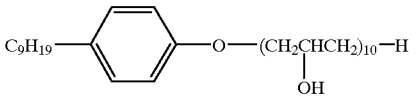

(Compounds represented by formula [SIII])

SIII-1

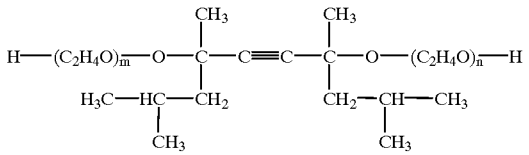

In formula SIII-1, m+n represents 1.3, 3.5, 10 or 30.

SIII-2

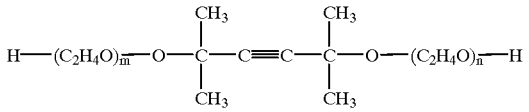

In formula SIII-2, m+n represents 1.3, 3.5, 10 or 30.

SIII-3

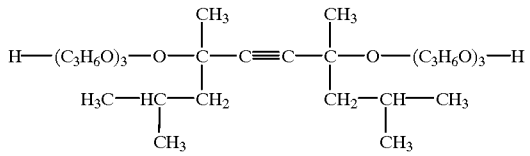

SIII-4

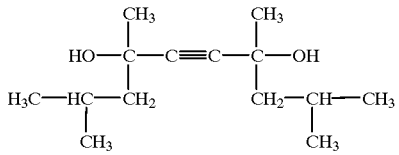

In the automatic processor for a silver halide photographic light-sensitive material of the invention, solute concentration of the processing solution is not less than 0.2% by weight. Further, the solute concentration of 0.4% by weight–20% by weight is preferable, and that of 1.0% by weight–10% by weight is especially preferable.

In the automatic processor for a silver halide photographic light-sensitive material of the invention, it is preferable that an amount of processing solution to be supplied from a processing solution supply means is in a range from 10 ml/m$^2$ to 100 ml/m$^2$ per 1 m$^2$ of a light-sensitive material, and from the viewpoint of prevention of solution dripping on an emulsion surface of light-sensitive material after the supply of a processing solution, a range from 15 ml/m$^2$ to 50 ml/m$^2$ is further preferable.

When supplying plural processing solutions to a light-sensitive material, it is possible to provide plural processing solution supply means to supply a processing solution to a light-sensitive material from the first processing solution supply means and then to supply a processing solution from the second processing solution supply means.

(Color development processing)

It is preferable that an automatic processor for a silver halide photographic light-sensitive material in the invention is used for a development processing step, especially for a color development processing step, and a color developer includes also a solution which can not complete color development reaction by itself. For example, a solution containing color developing agents and preserving agents, a solution of alkali agents only, a solution of surface active agents only, and mere water are included.

Though a solution which can complete color development reaction by itself may be supplied to an emulsion side of a light-sensitive material, it is also possible to make components necessary for color development processing reaction to be contained in plural separate solutions, and to supply them separately so that they are mixed on an emulsion side of a light-sensitive material for color development processing. The color development processing wherein necessary components are contained in plural processing solutions and are supplied separately is more preferable from the viewpoint of higher concentration of components and rapid processing.

The processing time of not less than 2 seconds, especially not less than 4 seconds in color development processing step is preferable for stable completion of color development processing, and the processing time of not more than 30 seconds, further of not more than 20 seconds, especially of not more than 15 seconds is preferable from the viewpoint of deterioration and drying of a color developer.

The processing time in the color development processing step mentioned here means a period of time from the moment when a color developer is first supplied to an emulsion side of a light-sensitive material to the moment when a processing solution for the succeeding step (for example, a bleaching step and a blix step) is supplied, or when the light-sensitive material is dipped in a processing solution for the succeeding step.

(Silver halide photographic light-sensitive material)

As an example of a light-sensitive material processed by the automatic processor for a silver halide photographic light-sensitive material of the invention, there are given a silver halide photographic light-sensitive material containing silver iodo-bromide or silver bromide and a silver halide monochromatic photographic light-sensitive material, but as a more preferable example, there are given a silver halide color photographic light-sensitive material containing a silver chloride emulation and a silver halide monochromatic photographic light-sensitive material. Further, it is preferable to have at least one emulsion layer containing silver halide emulsion whose 90% mol or more is composed of silver chloride. The silver halide emulsion whose 95–100 mol % is composed of silver chloride is more preferable, and that whose 98–100 mol % is composed of silver chloride is most preferable, from the viewpoint of advancement of processing.

(Embodiment of the invention)

Embodiment of an automatic processor for a silver halide photographic light-sensitive material in the invention will be explained in detail as follows, referring to drawings. These embodiment show concrete examples of the invention and do not limit meanings of terminology in the invention. Further, there are conclusive descriptions, and they show preferable examples as an embodiment, and they do not limit meanings of terminology of the invention either.

FIG. 1 is a diagram showing the schematic structure of an automatic processor for a silver halide photographic light-sensitive material. On automatic processor for a silver halide photographic light-sensitive material 1, there are arranged light-sensitive material loading section 2, cutting section 3, exposure section 4, development processing section 5, bleaching section 6, fixing section 7, stabling section 8 and drying section 9. In the light-sensitive material loading section 2, there is loaded paper magazine 10 housing therein silver halide photographic light-sensitive materials P. Silver halide photographic light-sensitive material P fed out of the paper magazine is cut to the prescribed length by cutter 11 in the cutting section 3. The silver halide photographic light-sensitive material P is sent to the exposure section 4 where a latent image is formed on the silver halide photographic light-sensitive material P through exposure.

In the development processing section 5, a development processing solution is jetted to the silver halide photographic light-sensitive material P for development processing, and a bleach processing solution is jetted to the silver halide photographic light-sensitive material P in the bleaching section 6 for bleach processing. Further, the silver halide photographic light-sensitive material P is further sent to the fixing section 7 and to stabling section 8 so that fixing and stabling are respectively conducted, thus the silver halide photographic light-sensitive material P processed by processing solutions is dried by the drying section 9 to be ejected out.

Figure 2:
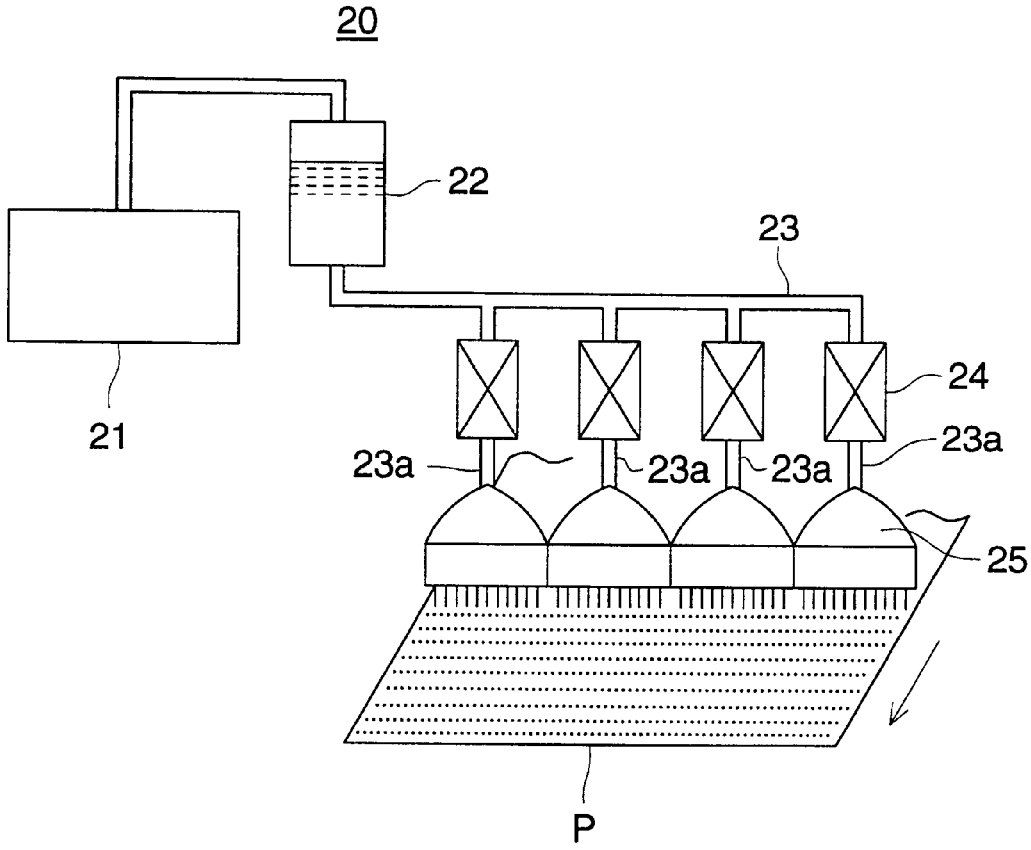
FIG. 2 is a diagram showing the schematic structure of a processing solution supply means.
Figure 3:
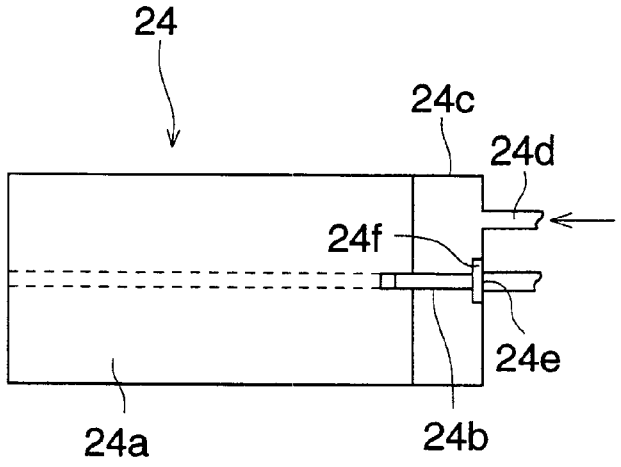
FIGS. 3(*a*) to 3(*c*) are diagrams showing the schematic structure of a control valve.
Figure 3:
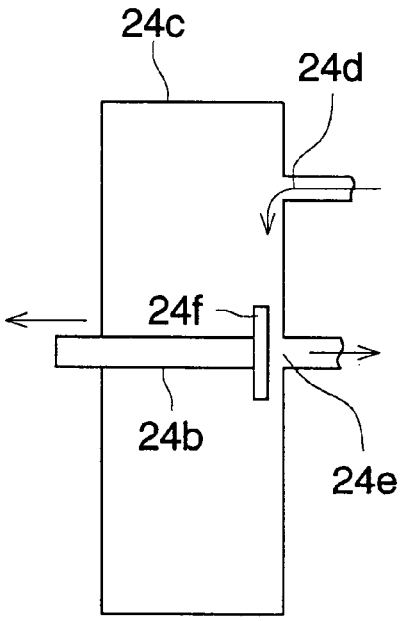
Figure 3:
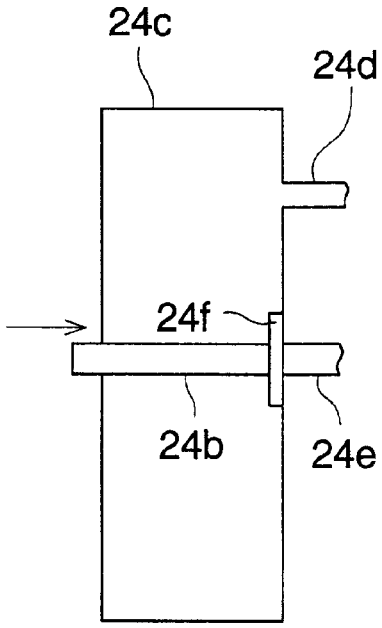
Figure 4:
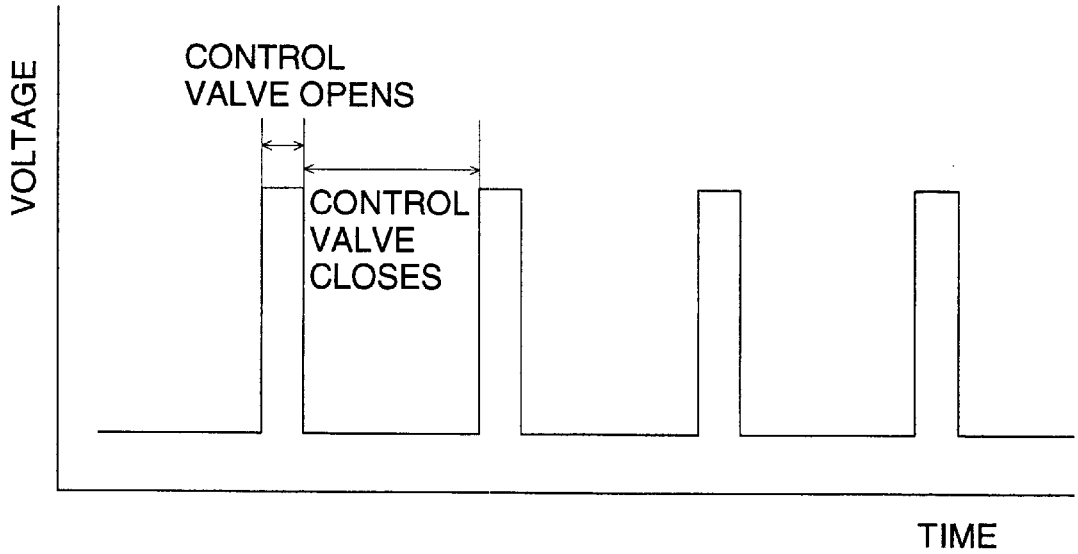
FIG. 4 is a diagram showing a control pulse of a control valve.
Figure 5:
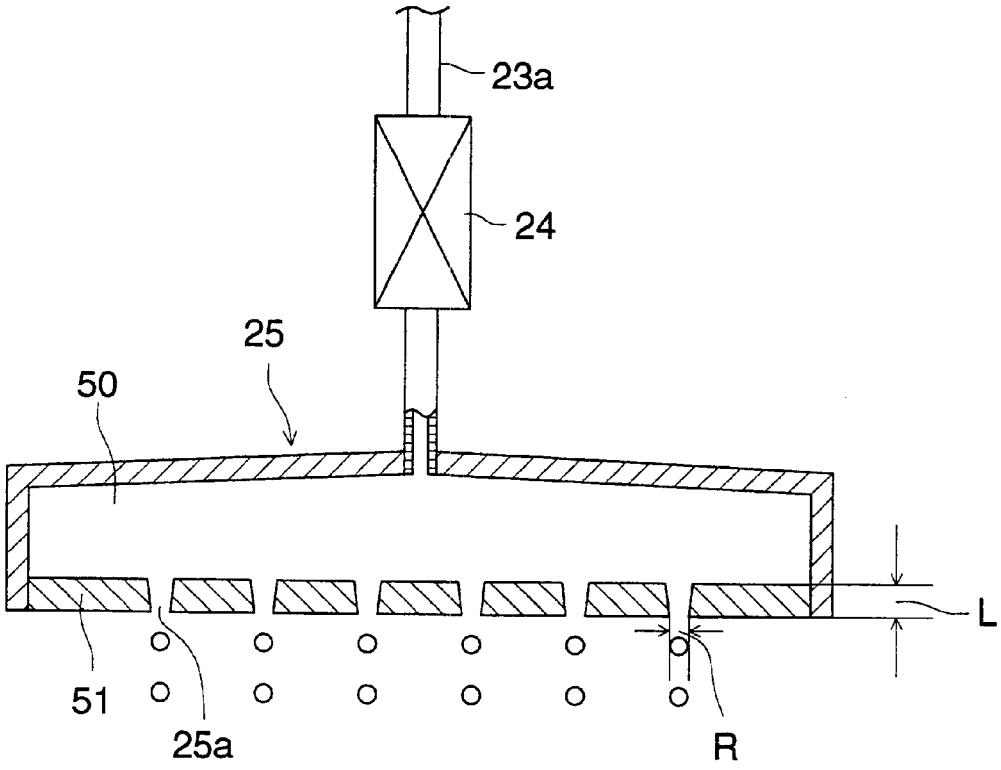
FIG. 5 is a sectional view showing an orifice.

On each of the development processing section 5 and the bleaching section 6, there is provided processing solution supply means 20 which is shown in FIG. 2–FIG. 5. FIG. 2 is a diagram showing the schematic structure of the processing solution supply means, FIG. 4 is a diagram showing a control pulse of a control valve, and FIG. 5 is a sectional view showing an orifice.

The processing solution supply means 20 is composed of compressor 21, supply tank 22, solution supply pipe 23, control valve 24 and nozzle 25 having orifice 25*a*. The solution supply pipe 23 coming from the supply tank 22 is branched into the plural number, and each branched solution supply pipe 23*a* is provided with control valve 24. A processing solution for silver halide photographic light-sensitive material P pressurized by compressor 21 is supplied directly to the silver halide photographic light-sensitive material P through jetting of the processing solution from orifice 25*a* of nozzle 25 caused by repetition of opening and shutting of the control valve 24.

As a result, the processing solution is coated evenly on the silver halide photographic light-sensitive material P. The nozzle 25 is one on which there are linearly arranged plural fine orifices 25*a* from which the pressurized processing solutions are jetted at a time by opening and shutting of the control valve 24. Nozzles 25 are usually arranged in a row to form an array. Different nozzle 25 is controlled independently, and is controlled in accordance with a paper size and with whether an image is present or not. It is preferable that a distance between silver halide photographic light-sensitive material P and orifice 25*a* of nozzle 25 is established to 1 mm–10 mm.

Control valve 24 is a valve controlling an action of opening and shutting of a flow path for the pressurized processing solution under which an action of opening and shutting is repeated by electric signals, and when the flow path is opened, the processing solution is jetted out of orifice 25*a*. As shown in FIG. 3, the control valve 24 is composed of solenoid 24*a*, valve body 24*b* and chamber 24*c*. On the tip of the valve body 24*b*, there is provided rubber member 24*f*, and when the solenoid 24*a* is turned on, the valve 24*b* moves so that outlet 24*e* covered by the rubber member 24*f* equipped on the tip may be opened. The pressurized processing solution is supplied from inlet 24*d* through the opening and shutting action of this valve body 24*b*, and is sent to nozzle 25 from the outlet 24*e*.

The control valve 24 has only to be one which can withstand a certain level of pressure. To be concrete, it is preferable that opening and shutting of the control valve is represented by opening and closing of a minute hole. The control by the control valve 24 is conducted by pulse waves shown in FIG. 4, and it is preferable that the number of times for opening and shutting per one second is 10–1000.

Duty ratio of the control valve 24 is adjusted in accordance with an amount of processing solution to be supplied. The duty ratio of the control valve 24 is defined by a ratio between opened time and closed time in a unit-hour, and when the duty ratio of the control valve 24 is adjusted, a large amount of jet can be obtained stably and aptitude for rapid operations is assured.

The nozzle 25 connected with the control valve 24 is constituted with manifold 50 and nozzle plate 51 as shown in FIG. 5. A processing solution flow path is expanded in the manifold 50 in a way that orifices 25a arranged linearly on the nozzle plate 51 jet uniformly.

For stable jetting of processing solutions for silver halide photographic light-sensitive material, a ratio of L representing a length of orifice 25*a* to R representing a diameter of the orifice on the jetting side is preferably within a range from 0.5 to 100, the more preferable range is from 2 to 40, and the range which is especially preferable is from 5 to 20.

The preferable length L of the orifice 25*a* is in a range from 0.05 mm to 5 mm, and the more preferable range is from 0.1 mm to 1 mm. The preferable diameter of the orifice 25*a* on the jetting surface side is within a range from 0.02 mm to 0.1 mm.

Further, a ratio of output cross section S1 at outlet 24*e* of the control valve 24 to total cross section S2 of orifices 25*a* representing a ratio (output cross section S1)/(total cross section S2) is in a range from 0.3 to 20, and a large amount of jet can be obtained stably, and aptitude for rapid operations is assured.

Figure 6:
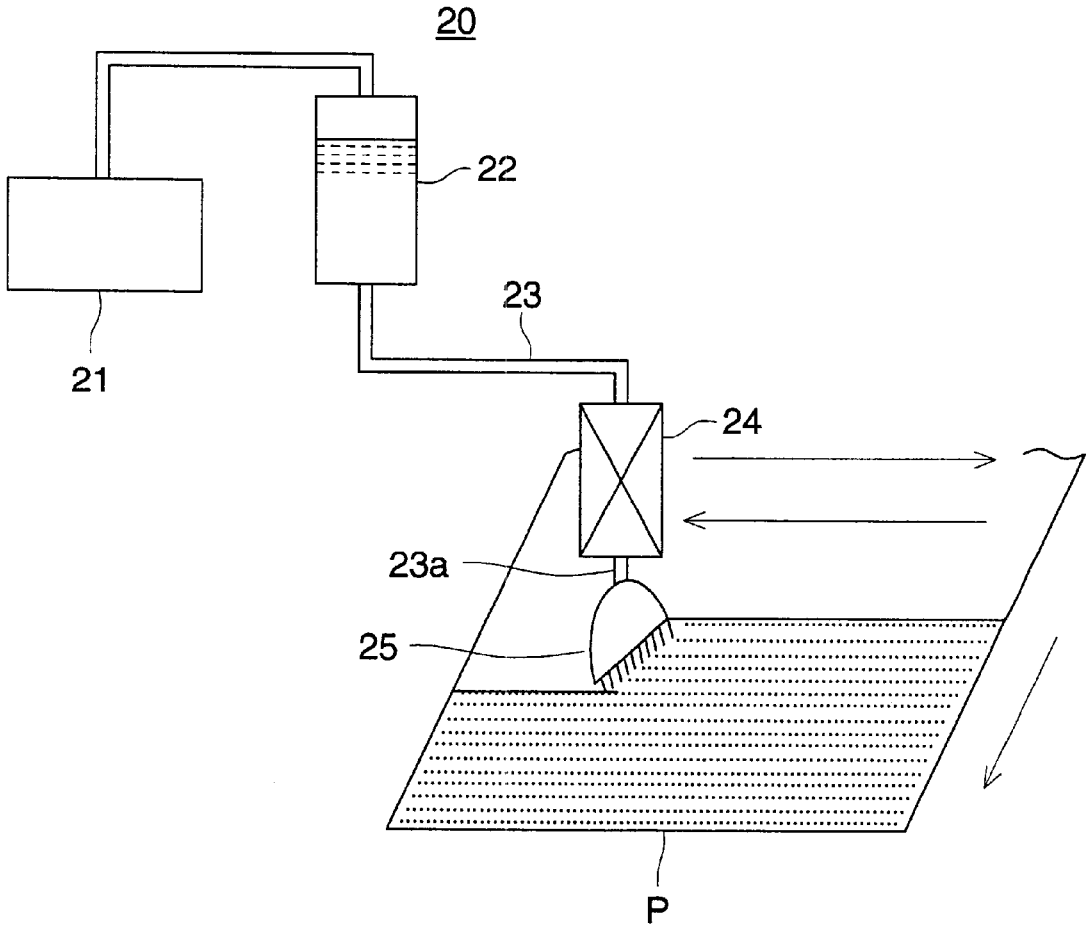
FIG. 6 is a diagram showing the schematic structure of another example of a processing solution supply means.

FIG. 6 is a diagram showing the schematic structure of another example of a processing solution supply means. In this embodiment, nozzle 25 is made to scan so that a processing solution may be coated evenly.

EXAMPLE 1

Tests for jetting the following processing solution were made by the use of the automatic processor for a silver halide photographic light-sensitive material.

| (Color developer of 1 liter) | |
|---|---|
| Water | 700 ml |
| Sodium sulfite | 0.1 g |
| Pentasodium salt of diethylenepentaamine pentaacetic acid | 3.0 g |
| Polyethylene glycol #4000 | 15 g |
| Bis(sulfoethyl)hydroxylamine disodium salt | 16 g |
| Tinopal SFP | 2 g |
| Potassium carbonate | 33 g |
| Sodium p-toluene sulfonate | 20 g |
| CD-3 | 12 g |
| Potassium hydroxide | 8 g |

Water was added to make a 1 liter solution. The solution was adjusted to pH 11.0, employing a sulfuric acid or potassium hydroxide solution.

The present invention

Continuous jetting was conducted at the rate represented by the number of times of 100/sec for opening and shutting of the control valve. There was used an automatic processor for a silver halide photographic light-sensitive material wherein driving voltage was 40 V and orifices in quantity of 50 were arranged at intervals of 0.5 mm. As an orifice pattern on the nozzle plate, the one shown in FIG. 4 was used. The number of orifices is 50 and outlet cross section S1 of the control valve is 0.25 $mm^2$. A nozzle plate having an orifice with a diameter of 30 $\mu$m was made. Pressure on the chamber was set to 0.5 $kgf/cm^2$.

Comparison

Continuous jetting was conducted while a control valve was kept open. Other conditions are the same as those in the present invention.

The invention showed good results having neither occurrence of contamination of a nozzle plate nor occurrence of mist. The comparative example, on the other hand, showed occurrence of mist and contamination of a nozzle plate, which were on the problematic level.

EXAMPLE 2

Under the same conditions as those in Example 1—1, nozzle plates having respectively orifice diameters described in Table 1 were prepared, and tests were made. Continuous jetting for 10 minutes was conducted, and then, a level of occurrence of mist was observed and the number of orifices which failed to jet was counted. A distance between the orifice and a light-sensitive material was set to 3 mm.

Contamination of the nozzle plate was observed, and the following evaluation conditions were used for evaluation.

A: Contamination caused by is not observed.

B: Slight contamination caused by solution dripping is observed.

C: There is clearly observed contamination caused by solution dripping, which is on a problematic level.

Occurrence of mist was observed, and the following evaluation conditions were used for evaluation.

A: Occurrence of mist is not observed.

B: Slight occurrence of mist is observed.

C: There is clearly observed occurrence of mist, which is on a problematic level.

TABLE 1

| Experiment No. | Orifice diameter (μm) | Ratio (output cross section S1/nozzle total cross section S2) | Frequency of occurrence of mist | Number of nozzles with jet failure | Contamination of nozzle plate |
|---|---|---|---|---|---|
| 2-1 | 160 | 0.25 | B | 5 | B |
| 2-2 | 150 | 0.28 | B | 1 | B |
| 2-3 | 140 | 0.32 | A-B | 0 | A-B |
| 2-4 | 100 | 0.64 | A | 0 | A-B |
| 2-5 | 76 | 1.1 | A | 0 | A |
| 2-6 | 40 | 4.0 | A | 0 | A |
| 2-7 | 32 | 6.2 | A | 0 | A |
| 2-8 | 26 | 9.4 | A | 1 | A |
| 2-9 | 18 | 19.7 | A | 1 | A-B |
| 2-10 | 16 | 24.9 | B | 3 | B |

It is found that jetting is stable, no mist is generated and the invention shows its effect effectively, when a ratio of output cross section S1 of the control valve to total cross section S2 of a nozzle (S1/S2 ) is in a range from 0.3 to 20. Further, when the ratio is in the range from 5 to 10, the invention shows more effect.

EXAMPLE 3

In Example 2–6, the number of times for opening and shutting per second for the control valve was changed as follows, and the same experiments as in the foregoing were made. The same evaluation as in the previous example was made.

TABLE 2

| Experiment No. | Number of times of opening and shutting per second | Frequency of occurrence of mist | Number of nozzles with jet failure |
|---|---|---|---|
| 3-1 | 3 times | B | 8 |
| 3-2 | 7 times | A-B | 5 |
| 3-3 | 10 times | A-B | 1 |
| 3-4 | 30 times | A | 0 |
| 3-5 | 50 times | A | 0 |
| 3-6 | 100 times | A | 0 |
| 3-7 | 200 times | A | 0 |
| 3-8 | 450 times | A | 0 |
| 3-9 | 500 times | A | 0 |
| 3-10 | 800 times | A-B | 0 |
| 3-11 | 1000 times | A-B | 0 |
| 3-12 | 1500 times | B | 3 |

When the number of times per second for opening and shutting of the control valve is made to be within a range from 10 times to 1000 times, occurrence of mist can be prevented and stable jetting is possible

EXAMPLE 4

In Example 2–6, the distance between a light-sensitive material and an orifice was changed as follows, and the same experiments as in the foregoing were made. Then, contamination of a nozzle plate was observed, in addition to the evaluation in Example 2.

TABLE 3

| Experiment No. | Distance W | Frequency of occurrence of mist | Number of nozzles with jet failure | Contamination of nozzle plate |
|---|---|---|---|---|
| 4-1 | 0.1 | A | 2 | B |
| 4-2 | 0.5 | A | 0 | A-B |
| 4-3 | 1.5 | A | 0 | A |
| 4-4 | 3 | A | 0 | A |
| 4-5 | 6 | A | 0 | A-B |
| 4-6 | 10 | A-B | 0 | A-B |
| 4-7 | 12 | B | 0 | B |

When distance W is set to 0.5–10 mm, occurrence of mist is improved and contamination of an orifice plate is reduced.

EXAMPLE 5

Processing was conducted under the following processing conditions by the use of the automatic processor for a silver halide photographic light-sensitive material shown in FIG. 1.

| (Processing time) Processing step | Processing time | Amount of supply ($ml/m^2$) | Processing temperature (° C.) |
|---|---|---|---|
| Color development processing | 12 seconds | Described in Table 3 | 45 |
| Bleaching processing | 10 seconds | 30 | 45 |
| Fixing processing | 10 seconds | 60 | 40 |
| Stabilizing processing | 27 sec × 3 | 120 | 40 |

| Color developer (1 liter) | |
|---|---|
| Water | 700 ml |
| Sodium sulfite | 0.1 g |
| Pentasodium salt of diethylenepentaamine pentaacetic acid | 30 g |
| Polyethylene glycol #4000 | 15 g |
| Bis(sulfoethyl)hydroxylamine disodium salt | 16 g |
| Tinopai SFP (brightening agent) | 2 g |
| Potassium carbonate | 33 g |
| Sodium p-toluene sulfonate | 20 g |
| CD-3 | 15 g |
| Potassium hydroxide | 8 g |

Water was added to make a 1 liter solution. The solution was adjusted to pH 11.0, employing a sulfuric acid or potassium hydroxide solution.

| Bleach (1 liter) | |
|---|---|
| Water | 500 g |
| Ferric ammonium salt of ethylenediamine tetraacetic acid | 120 g |
| Ethylenediamine tetraacetic acid | 5 g |
| Ammonium bromide | 80 g |
| Maleic acid | 15 g |

Water was added to make a 1 liter solution. The solution was adjusted to pH 4.0, employing an aqueous 25% ammonia or an acetic acid solution.

| Fixer (1 liter) | |
|---|---|
| Water | 500 ml |
| Sodium thiosulfate | 150 g |
| Sodium sulfite | 18 g |
| Diasodium salt of ethylenediamine tetraacetic acid | 5 g |

Water was added to make a 1 liter solution. The solution was adjusted to pH 7.0, employing an aqueous 25% ammonia or an acetic acid solution.

Stabilizing solution

Stabilizing was carried out, employing a stabilizer replenisher P-3 which is used in CPK-2-28 manufactured by Konica Corporation.

(Light-sensitive material)

QA paper Type A6 (having an emulsion layer which contains silver halide emulsion whose 99.9% or more is silver chloride) exposed in an ordinary method was processed.

(Processing solution supply section)

A control valve and a nozzle which are the same as those in Examples 2–3 were used. The number of times for opening and shutting of the control valve was established in accordance with an amount of supply to a light-sensitive material. By adjusting a frequency, an amount of supply of a color developing solution was changed as shown in Table 4 for experiments.

A light-sensitive material subjected to ordinary wedge exposure was processed, and spectral maximum reflection density Dmax (Y) for 440 nm and spectral reflection density for 440 nm for an unexposed portion (Dmin (Y)) were measured. Further, a frequency of occurrence of development unevenness was observed. In the present example, Dmax (Y) which is 2.0 or more is regarded as sufficient density. The results are shown in Table 4.

TABLE 4

| Experiment No. | Amount of solution supplied ($ml/m^2$) | Dmax(Y) | Dmin(Y) | Development unevenness |
|---|---|---|---|---|
| 5-1 | 4 | 1.50 | 0.090 | B |
| 5-2 | 5 | 1.95 | 0.090 | A |
| 5-3 | 10 | 2.05 | 0.090 | A |
| 5-4 | 20 | 2.10 | 0.090 | A |
| 5-5 | 30 | 2.10 | 0.090 | A |
| 5-6 | 60 | 2.10 | 0.095 | A |

TABLE 4-continued

| Experiment No. | Amount of solution supplied ($ml/m^2$) | Dmax(Y) | Dmin(Y) | Development unevenness |
|---|---|---|---|---|
| 5-7 | 90 | 2.10 | 0.099 | A |
| 5-8 | 100 | 2.10 | 0.105 | A |
| 5-9 | 110 | 2.05 | 0.115 | B |

It is found from Table 3 that excellent efficiency is exhibited when an amount of solution supplied is set to 5–100 $ml/m^2$.

EXAMPLE 6

The same experiment as in Examples 2–3 was conducted by adjusting surface tension of a processing solution as shown in Table 5. In addition to the evaluation in Example 2, contamination of a nozzle plate was observed.

TABLE 5

| Experiment No. | Additives | Surface tension (dyne/cm) | Frequency of occurrence of mist | Number of nozzles with jet failure | Contamination of nozzle plate |
|---|---|---|---|---|---|
| 6-1 | None | 60 | A | 2 | B |
| 6-2 | SII-11 0.05 g/l | 50 | A | 0 | A-B |
| 6-3 | SII-11 0.1 g/l | 45 | A | 0 | A |
| 6-4 | SII-11 0.5 g/l | 35 | A | 0 | A |
| 6-5 | I-13 0.2 g/l | 30 | A | 0 | A |
| 6-6 | I-13 0.8 g/l | 25 | A | 1 | A |
| 6-7 | I-13 1.5 g/l | 20 | A-B | 2 | A-B |

It is found from Table 5 that excellent efficiency is exhibited when surface tension is set to 25–50 dyne/cm.

As stated above, in the structure described in Structure 1 wherein the processing solution is supplied directly to a silver halide photographic light-sensitive material by jetting the pressurized processing solution for a silver halide photographic light-sensitive material through repetition of opening and shutting of a control valve, it is possible to obtain a large amount of jetting stably, aptitude for rapid operations is assured, spot problems of color development are not caused, neither deflection of jetting direction nor occurrence of mist is caused, maintenance is easy, no clogging of orifice is caused for the use for a long time, and an amount of waste solution is small to give less load to environment.

In the structure described in Structure 2, it is possible to obtain a large amount of jet stably by adjusting a duty ratio of the control valve according to an amount of a processing solution to be supplied, and aptitude for rapid operations is assured.

In the structure described in Structure 3, it is possible to jet uniformly in a wide range and to obtain a large amount of jet stably, and aptitude for rapid operations is assured, because one control valve is communicated with plural orifices for jetting processing solution.

In the structure described in Structure 4, the number of times for opening and shutting of the control valve per second is in a range from 10 to 1000, mist is not caused, a large amount of jet can be obtained stably, and aptitude for rapid operations is assured.

In the structure described in Structure 5, a ratio (output cross section)/(total cross section) representing a ratio of an output cross section of a control valve to the total cross section of orifices is in a range from 0.3 to 20, and a large amount of jet can be obtained stably, and aptitude for rapid operations is assured.

In the structure described in Structure 6, a distance between the orifice and the silver halide photographic light-sensitive material is within a range from 0.5 mm to 10 mm, and neither deflection of jetting direction nor occurrence of mist is caused, and maintenance is easy.

In the structure described in Structure 7, processing characteristics are excellent, aptitude for rapid operations is assured, and spot problems in color development are not caused, because a silver halide photographic light-sensitive material is heated up to 45 degrees or more.

In the structure described in Structure 8, solution dripping on an emulsion surface of the silver halide photographic light-sensitive material after supply of the processing solution can be prevented, and it is possible to conduct processing which emits less amount of waste solution for less load to environment, because an amount of supplied processing solution is controlled to 5 ml–100 ml per 1 $m^2$ of the silver halide photographic light-sensitive material.

In a preferable embodiment of the invention, surface tension of a processing solution is 25–40 dyne/cm, and it is possible to prevent dripping of a solution on an emulsion side of a silver halide photographic light-sensitive material after the supply of a processing solution.

In another preferably embodiment, solute concentration of a processing solution is not less than 0.2% by weight, and rapid processing is possible.

What is claimed is:

1. An apparatus for processing a photographic light sensitive material with a processing solution, comprising:

a jetting head provided so as to face the photographic light sensitive material with air space and having a plurality of orifices through which the processing solution is jetted toward the photographic light sensitive material;

a supplying device to apply a pressure to the processing solution and to supply the pressed processing solution to the jetting head;

a conduit provided between the supplying device and the jetting head so as to transmit the pressed processing solution from the supplying device to the jetting head;

a valve provided on the conduit so as to open or close the conduit;

a controller to control a supplying amount of the processing solution by controlling a duty ratio of an opening time period to a closing time period of the valve per a unit time, wherein a ratio of a length to a diameter of each orifice is 0.5 to 100.

2. The apparatus of claim 1, wherein the controller controls the valve so as to repeat opening and closing 10 times to 1000 times per seconds.

3. The apparatus of claim 1, wherein a number of orifices is 2 to 250.

4. The apparatus of claim 1, wherein a length of each orifice is 0.05 mm to 5 mm.

5. The apparatus of claim 1, wherein a diameter of each orifice is 0.02 mm to 0.1 mm.

6. The apparatus of claim 1, wherein an output port of each orifice is distant from the photographic light sensitive material with a distance of 0.5 mm to 10 mm.

7. The apparatus of claim 1, wherein the valve has a sectional area S1 to deliver the processing solution, the plurality of orifices have a total area S2 calculated by summing a sectional area of each orifice and a ratio of S1/S2 is 0.3 to 20.

8. The apparatus of claim 1, wherein the pressure applied to the processing solution is 0.05 $Kgf/cm^2$ to 3.0 $Kgf/cm^2$.

9. The apparatus of claim 1, wherein the supplying device supplies the processing solution to the photographic light sensitive material with a supplying speed of 0.01 ml/second to 2.5 ml/second.

10. The apparatus of claim 1, wherein the supplying device supplies the processing solution to the photographic light sensitive material in an amount of 5 ml to 100 ml per 1 $m^2$ of the photographic light sensitive material.

11. The apparatus of claim 1, wherein a surface tension of the processing solution is 25 dyne/cm to 50 dyne/cm.

12. The apparatus of claim 1, further comprising a heater to heat the photographic light sensitive material to 45° C. or more.

13. The apparatus of claim 1, wherein the ratio of the length to the diameter of each orifice is 2 to 40.

14. The apparatus of claim 13, wherein the ratio of the length to the diameter of each orifice is 5 to 20.

* * * * *